US005915671A

United States Patent [19]

Bott

[11] Patent Number: 5,915,671

[45] Date of Patent: Jun. 29, 1999

[54] WALL JACK APPARATUS

[76] Inventor: David N. Bott, 5621-34th Ave. E., Tacoma, Wash. 98443

[21] Appl. No.: 08/906,231

[22] Filed: Aug. 4, 1997

[51] Int. Cl.[6] ..... B66F 3/00

[52] U.S. Cl. ..... 254/124; 269/71; 269/287

[58] Field of Search ..... 294/106, 109, 294/90, 91, 119.2; 254/124, 8 R, 8 B, 8 C, 132, 30; 269/71, 287

[56] References Cited

U.S. PATENT DOCUMENTS

| | | | |
|---|---|---|---|
| 1,021,984 | 4/1912 | Holmes | 294/90 |
| 2,828,870 | 4/1958 | Corley . | |
| 3,058,602 | 10/1962 | Kilman . | |
| 3,201,089 | 8/1965 | Napoletano | 254/124 |
| 3,871,427 | 3/1975 | Widegren et al. | 254/132 |
| 4,531,720 | 7/1985 | Söder . | |
| 4,650,389 | 3/1987 | Mulqueen . | |
| 4,810,151 | 3/1989 | Shem . | |
| 5,118,247 | 6/1992 | Royden . | |

*Primary Examiner*—Robert C. Watson

[57] ABSTRACT

A wall jack apparatus includes a base assembly which includes a central arm support portion. A telescopic lift arm assembly includes a proximal lift arm end which is pivotally connected to the arm support portion at a relatively low first connection position. A telescopic push arm assembly includes a proximal push arm end which is pivotally connected to the arm support portion at a relatively high second connection position. The distal lift arm end of the telescopic lift arm assembly is pivotally connected to a pivoting portion of the telescopic push arm assembly between the proximal push arm end and the distal push arm end. A clamping assembly is pivotally connected to the distal push arm end. The base assembly further includes a plurality of legs is connected to the arm support portion. A plurality of feet are connected to the legs. The legs project laterally from the arm support portion of the base assembly, and the feet are located substantially horizontally with respect to the arm support portion of the base assembly. The distal push arm end includes a hinge assembly. The clamping assembly includes a first jaw member which includes first hinge pin receivers connected to the hinge assembly. A second jaw member includes second hinge pin receivers connected to the hinge assembly. Jaw locking means are connected to the first and second jaw members for locking the first and second jaw members together.

5 Claims, 3 Drawing Sheets

FIG 1
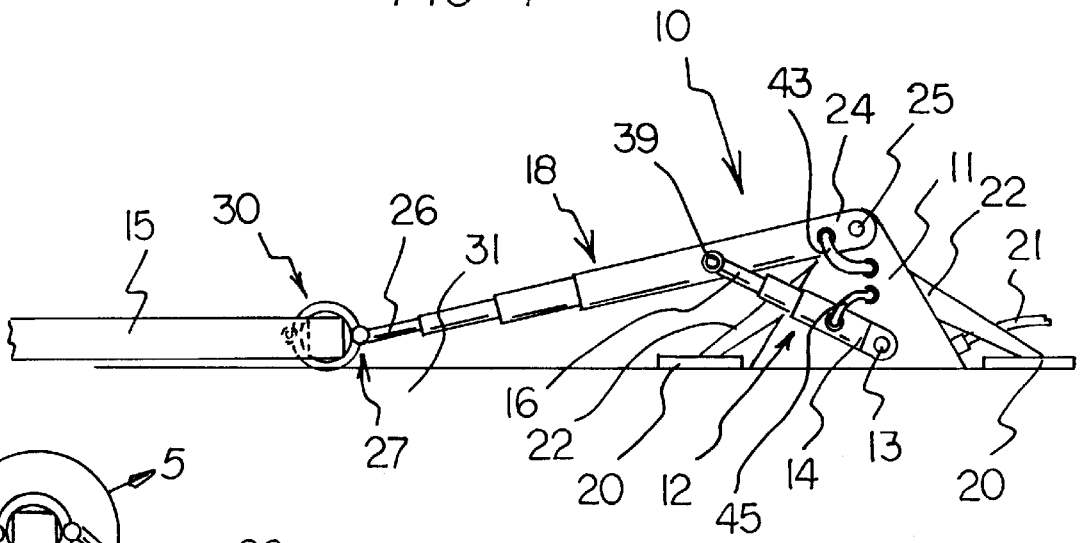
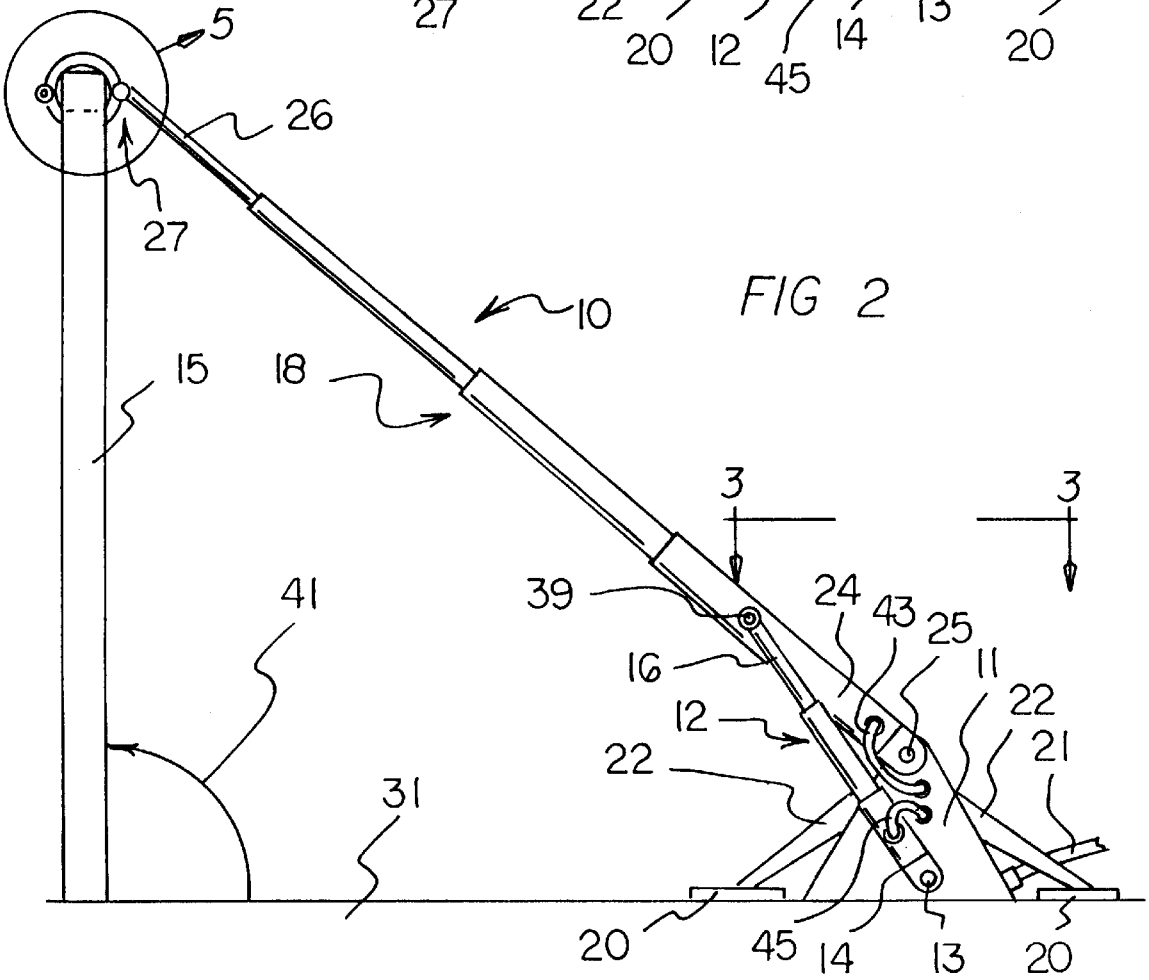
FIG 2

4
22

20
22
24
11
18
23
20
21
20
39
25
45
16
12
43
14
13
22

39
18
16
24

12
11
25
22
22
20
14
13
21
23
20

FIG 5
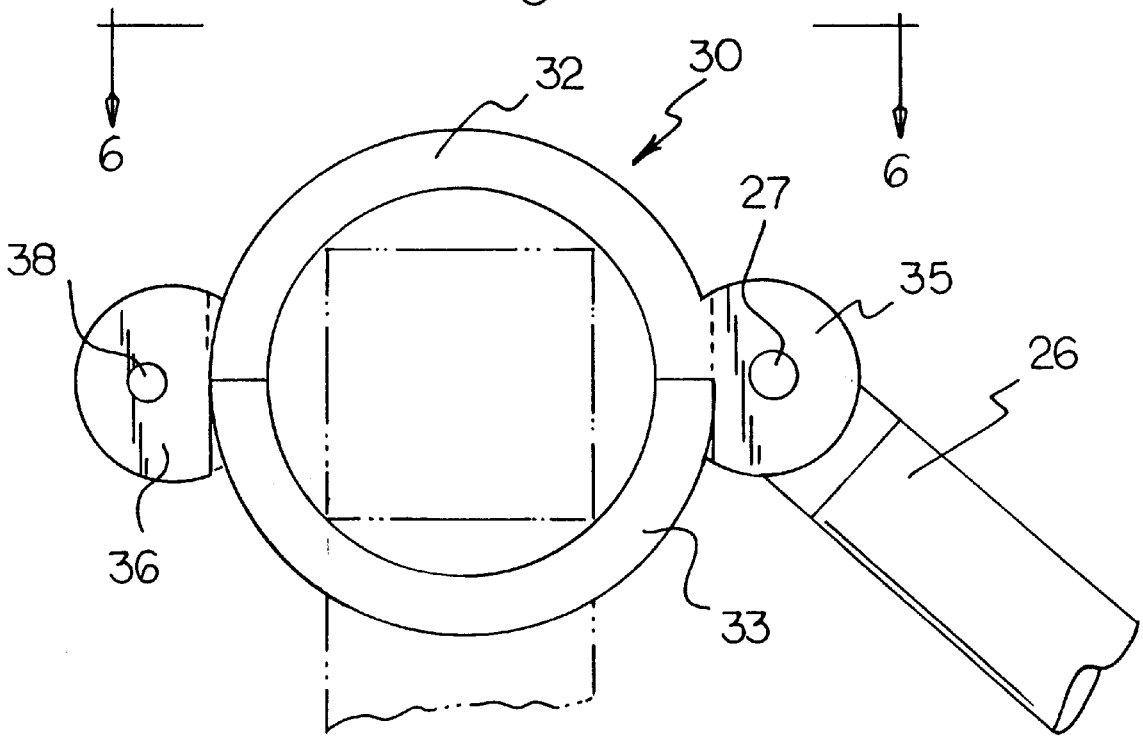
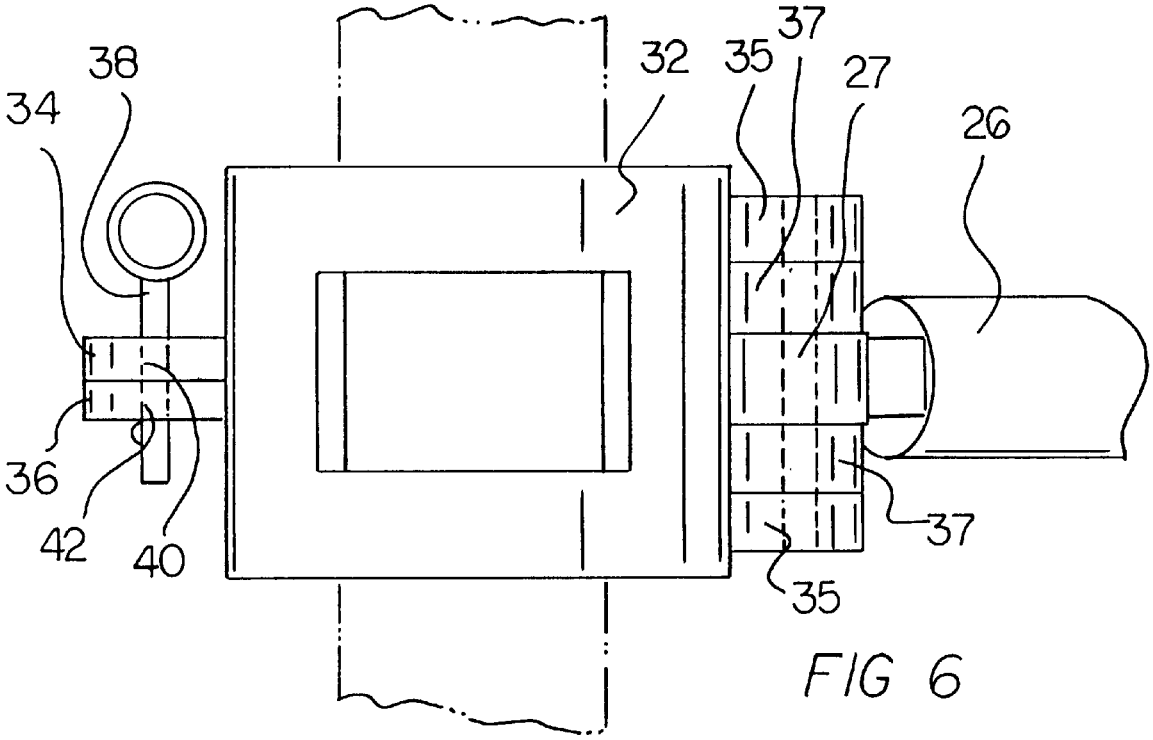
FIG 6

WALL JACK APPARATUS

BACKGROUND OF THE INVENTION

1. Field of the Invention

The present invention relates generally to devices used in the building construction field and, more particularly, to devices especially adapted for raising a wall unit.

2. Description of the Prior Art

When the framing in walls of houses is made from wood, workers at the building site often lift wall units manually from an nonerected horizontal orientation to an erected vertical orientation. In so doing, the workers often put considerable stress on their bodies, especially their backs. To avoid placing such stresses on workers' backs, it would be desirable if a device were provided which mechanically raises a wall unit from a horizontal to a vertical orientation.

At a work site, electrical power is often available for powering various equipment used during construction. In this respect, it would be desirable if a device were provided at a construction site that mechanically raises a wall unit and that is electrically powered.

Also, at a work site, hydraulic power, such as power from compressed air, is often available for powering various equipment, such as nail guns. In this respect, it would be desirable if a device were provided at a construction site that employs hydraulic power for raising a wall unit from a horizontal to a vertical orientation.

Throughout the years, one prior art mechanical arrangement for raising wall units from a horizontal to a vertical orientation involves the use of a wall jack that is mounted on a piece of wood and that is jacked by hand from a ladder. Such use of a ladder may be hazardous and susceptible to undesirable falls. In this respect, it would be desirable is a wall jack device were provided that does not employ a ladder.

Force multiplication using the laws of hydraulics is well known, and force multiplication techniques are used in hydraulic jacks. In this respect, it would be desirable is a wall lifting jack were provided that employed force multiplication using hydraulics.

For purposes of convenience and ease of use, it would also be desirable if a wall jack apparatus were provided in the form of an electrically powered, hydraulics employing, portable, self-contained unit that can readily be transported to a construction site and utilized at the site.

For purposes of durability and efficiency, it would be desirable if a wall jack apparatus were provided in the form of a portable unit that is light in weight, is structurally sound, and has relatively few moving parts.

Thus, while the foregoing background discussion indicates it to be well known to use a manually operated wall jack, the prior art described above does not teach or suggest a wall jack apparatus which has the following combination of desirable features: (1) mechanically raises a wall unit from a horizontal to a vertical orientation using a non-manual power source; (2) mechanically raises a wall unit using electrical power; (3) employs hydraulic power for raising the wall unit; (4) does not employ a ladder; (5) employs force multiplication using hydraulics; (6) is provided as an electrically powered, hydraulics employing, portable, self-contained unit that can readily be transported to a construction site and utilized at the site; and (7) is in the form of a portable unit that is light in weight, is structurally sound, and has relatively few moving parts. The foregoing desired characteristics are provided by the unique wall jack apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a wall jack apparatus which includes a base assembly which includes a central arm support portion. A telescopic lift arm assembly includes a proximal lift arm end which is pivotally connected to the arm support portion at a relatively low first connection position. The telescopic lift arm assembly also includes a distal lift arm end. A telescopic push arm assembly includes a proximal push arm end which is pivotally connected to the arm support portion at a relatively high second connection position. The telescopic push arm assembly includes a distal push arm end. The distal lift arm end of the telescopic lift arm assembly is pivotally connected to a pivoting portion of the telescopic push arm assembly between the proximal push arm end and the distal push arm end. A clamping assembly is pivotally connected to the distal push arm end. The base assembly further includes a plurality of legs is connected to the arm support portion. A plurality of feet are connected to the legs. The legs project laterally from the arm support portion of the base assembly, and the feet are located substantially horizontally with respect to the arm support portion of the base assembly.

The distal push arm end includes a hinge assembly. The clamping assembly includes a first jaw member which includes first hinge pin receivers connected to the hinge assembly. A second jaw member includes second hinge pin receivers connected to the hinge assembly. Jaw locking means are connected to the first and second jaw members for locking the first and second jaw members together.

The jaw locking includes a first locking finger which projects from the first jaw member. A second locking finger projects from the second jaw member, and a lock pin is connected between the first locking finger and the second locking finger. The first locking finger includes a first pin-receiving channel, and the second locking finger includes a second pin-receiving channel. The lock pin is placed through the first pin-receiving channel and the second pin-receiving channel when the first pin-receiving channel and the second pin-receiving channel are placed in registration.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wall jack apparatus which has all of the advantages of the prior art and none of the disadvantages.

It is another object of the present invention to provide a new and improved wall jack apparatus which may be easily and efficiently manufactured and marketed.

It is a further object of the present invention to provide a new and improved wall jack apparatus which is of durable and reliable construction.

An even further object of the present invention is to provide a new and improved wall jack apparatus which is susceptible of a low cost of manufacture with regard to both materials and labor, and which accordingly is then susceptible of low prices of sale to the consuming public, thereby making such wall jack apparatus available to the buying public.

Still yet a further object of the present invention is to provide a new and improved wall jack apparatus which mechanically raises a wall unit from a horizontal to a vertical orientation using a non-manual power source.

Still another object of the present invention is to provide a new and improved wall jack apparatus that mechanically raises a wall unit using electrical power.

Yet another object of the present invention is to provide a new and improved wall jack apparatus which employs hydraulic power for raising a wall unit.

Even another object of the present invention is to provide a new and improved wall jack apparatus that does not employ a ladder.

Still a further object of the present invention is to provide a new and improved wail jack apparatus which employs force multiplication using hydraulics.

Yet another object of the present invention is to provide a new and improved wall jack apparatus that is an electrically powered, hydraulics employing, portable, self-contained unit that can readily be transported to a construction site and utilized at the site.

Still another object of the present invention is to provide a new and improved wall jack apparatus which is in the form of a portable unit that is light in weight, is structurally sound, and has relatively few moving parts.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a preferred embodiment of the wall jack apparatus of the invention clamping onto a wall unit in a horizontal orientation.

FIG. 2 is a side view of the embodiment of the wall jack apparatus shown in FIG. 1 after having raised the wall unit to an erected vertical orientation.

FIG. 5 is an enlarged side view of the clamping jaw portion of the embodiment of the invention shown in the circled region 5 of FIG. 2.

FIG. 6 is a top view of the portion of the embodiment of the invention shown in FIG. 5 taken along line 6—6 thereof.

DESCRIPTION OF THE PREFERRED EMBODIMENT

With reference to the drawings, a new and improved wall jack apparatus embodying the principles and concepts of the present invention will be described.

Figure 3:
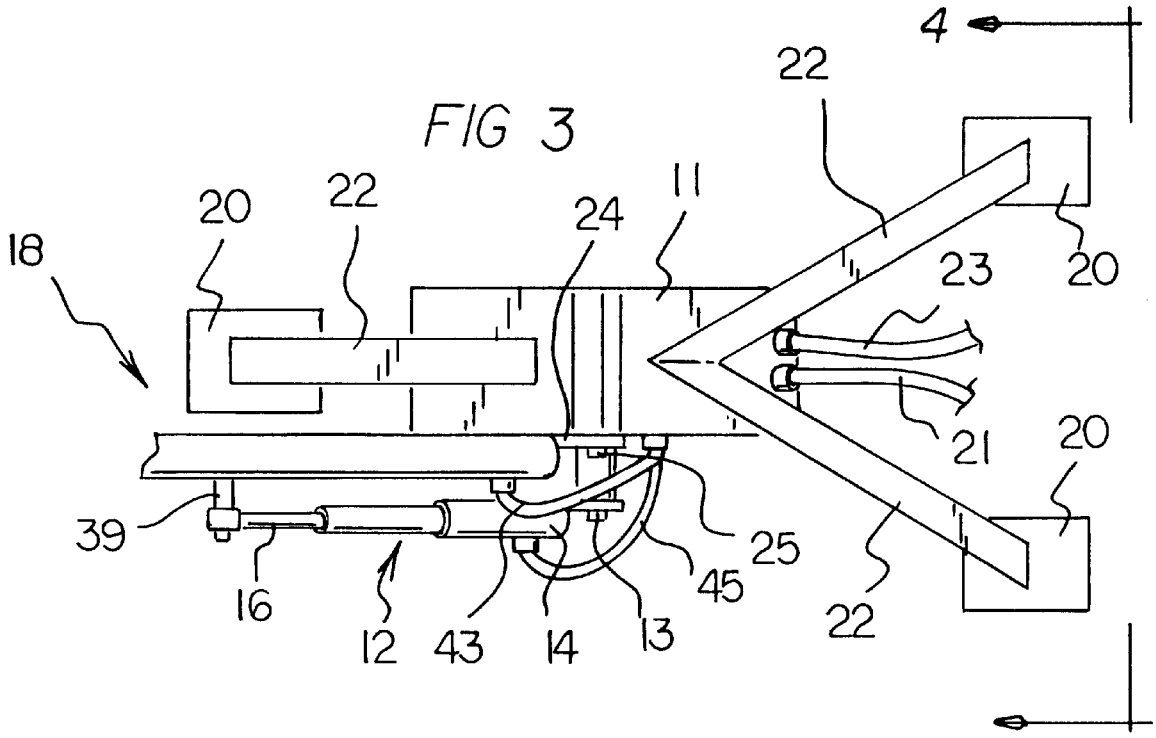
FIG. 3 is an enlarged top view of a portion of the embodiment of the invention of FIG. 2 taken along line 3—3 thereof.
Figure 4:
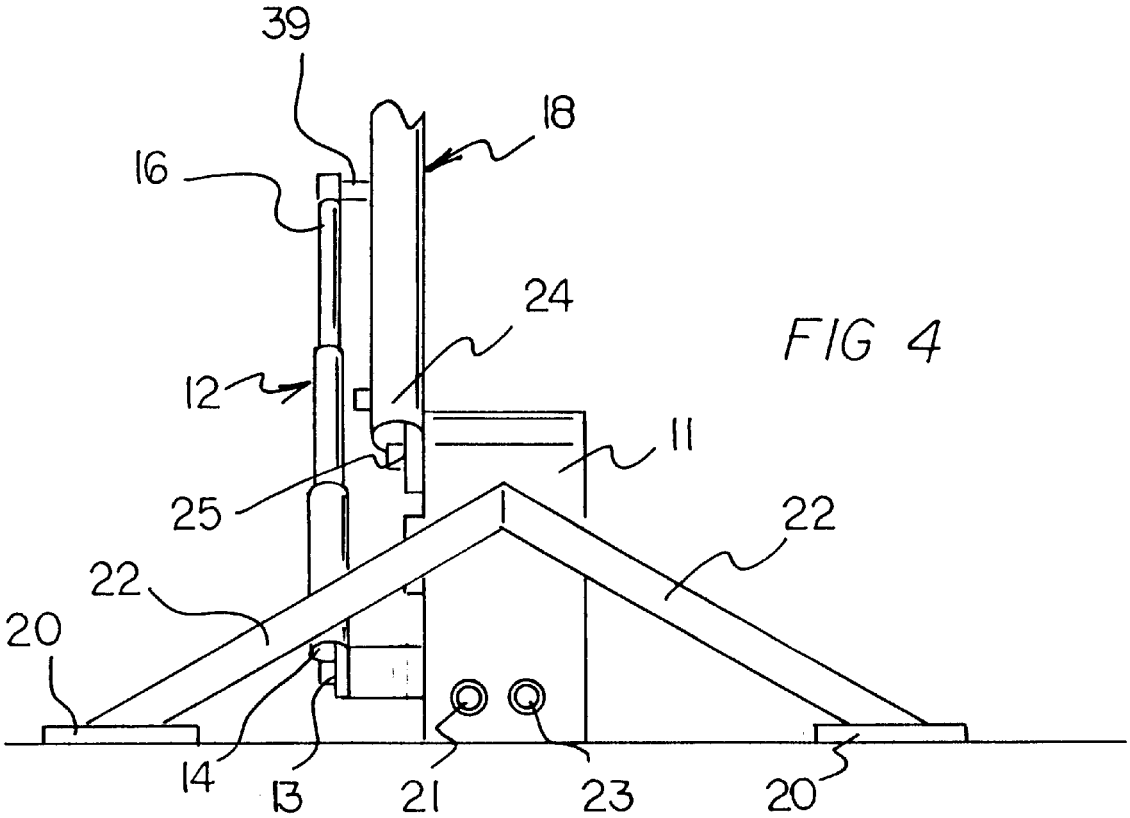
FIG. 4 is a rear view of the embodiment of the invention shown in FIG. 3 taken along line 4—4 thereof.

Turning to FIGS. 1–6, there is shown an exemplary embodiment of the wall jack apparatus of the invention generally designated by reference numeral 10. In its preferred form, wall jack apparatus 10 includes a base assembly which includes a central arm support portion 11. A telescopic lift arm assembly 12 includes a proximal lift arm end 14 which is pivotally connected to the arm support portion 11 at a relatively low first connection position 13. The telescopic lift arm assembly 12 also includes a distal lift arm end 16. A telescopic push arm assembly 18 includes a proximal push arm end 24 which is pivotally connected to the arm support portion 11 at a relatively high second connection position 25. The telescopic push arm assembly 18 includes a distal push arm end 26. The distal lift arm end 16 of the telescopic lift arm assembly 12 is pivotally connected to a pivoting portion 39 of the telescopic push arm assembly 18 between the proximal push arm end 24 and the distal push arm end 26. A clamping assembly 30 is pivotally connected to the distal push arm end 26. The base assembly further includes a plurality of legs 22 is connected to the arm support portion 11. A plurality of feet 20 are connected to the legs 22. The legs 22 project laterally from the arm support portion 11 of the base assembly, and the feet 20 are located substantially horizontally with respect to the arm support portion 11 of the base assembly.

The distal push arm end 26 includes a hinge assembly 27. The clamping assembly 30 includes a first jaw member 32 which includes first hinge pin receivers 35 connected to the hinge assembly 27. A second jaw member 33 includes second hinge pin receivers 37 connected to the hinge assembly 27. Jaw locking means are connected to the first and second jaw members for locking the first and second jaw members together.

The jaw locking includes a first locking finger 34 which projects from the first jaw member 32. A second locking finger 36 projects from the second jaw member 33, and a lock pin 38 is connected between the first locking finger 34 and the second locking finger 36. The first locking finger 34 includes a first pin-receiving channel 40, and the second locking finger 36 includes a second pin-receiving channel 42. The lock pin 38 is placed through the first pin-receiving channel 40 and the second pin-receiving channel 42 when the first pin-receiving channel 40 and the second pin-receiving channel 42 are placed in registration.

To use the wall jack apparatus 10, a wall frame unit 15 is obtained. With the wall frame unit 15 in a non-erected horizontal orientation, as shown in FIG. 1, the clamping assembly 30 is clamped onto the top frame member of the wall frame unit 15. More specifically, the lock pin 38 is removed from the first and second locking fingers 34, 36. The first and second jaw members 32, 33 are separated around hinge assembly 27. The top frame member of the wall frame unit 15 is placed between the open first and second jaw members 32, 33, and the jaw members 32, 33 are closed. The first pin-receiving channel 40 and the second pin-receiving channel 42 of the respective first locking finger 34 and the respective second locking finger 36 are placed in registration, and the lock pin 38 is inserted through the first pin-receiving channel 40 and the second pin-receiving channel 42. In this way, the clamping assembly 30 is locked onto the wall frame unit 15.

Although a variety of sources of motive power can be employed, as shown in the figures, the telescopic lift arm assembly 12 and the telescopic push arm assembly 18 are powered by hydraulic pressure. A source hydraulic pressure (not shown) provides hydraulic pressure to pressure line 21. A return line 23 returns the hydraulic medium back to the source of hydraulic pressure.

To raise the wall frame unit 15 from the non-erected horizontal position shown in FIG. 1 to the erected vertical position shown in FIG. 2, hydraulic pressure is directed through hydraulic line 45 to the telescopic lift arm assembly 12. When this is done, the telescopic lift arm assembly 12 telescopes from the non-extended state shown in FIG. 1 to the extended state shown in FIG. 2. The extension of the telescopic lift arm assembly 12 causes the telescopic push arm assembly 18 to be lifted vertically off of the floor 31. Since the wall frame unit 15 is connected to the telescopic push arm assembly 18, the wall frame unit 15 is also lifted vertically off of the floor 31.

In addition, hydraulic pressure is directed to the telescopic push arm assembly 18. At first, the telescopic push arm assembly 18 is in a nonextended state, as shown in FIG. 1. However, as hydraulic pressure is applied to the telescopic push arm assembly 18 through hydraulic line 43, the telescopic push arm assembly 18 is extended to the extended state as shown in FIG. 2. As this occurs, the wall frame unit 15 is pushed from around its base in a counterclockwise direction as shown by curved arrow 41. Thus, by the combined lifting action of the telescopic lift arm assembly 12 and the telescopic push arm assembly 18, the wall frame unit 15 is erected to the vertical orientation from the horizontal orientation. Once the wall frame unit 15 is in the vertical orientation, the lock pin 38 can be removed, and the clamping assembly 30 can be removed from the wall frame unit 15. Then, both the telescopic lift arm assembly 12 and the telescopic push arm assembly 18 can be retracted to the nonextended states shown in FIG. 1 for use in erecting another wall frame unit 15.

It is noted that as the wall frame unit 15 is lifted from the horizontal to the vertical orientation, the clamping assembly 30 rotates around the hinge assembly 27. Similarly, as the distal lift arm end 16 rotates around the pivoting portion 39, the proximal lift arm end 14 rotates around the first connection position 13, and the proximal push arm end 24 rotates around the second connection position 25.

The hydraulic medium can be any suitable medium such as compressed air or a liquid hydraulic fluid. Moreover, the wall jack apparatus 10 of the invention can be manufactured as a collapsible, portable, self-contained unit. Such a portable unit can be either electrically powered or powered by hydraulic pressure.

The components of the wall jack apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved wall jack apparatus that is low in cost, relatively simple in design and operation, and which may advantageously be used to mechanically raise a wall unit from a horizontal to a vertical orientation using a non-manual power source. With the invention, a wall jack apparatus is provided which mechanically raises a wall unit using electrical power. With the invention, a wall jack apparatus is provided which employs hydraulic power for raising the wall unit. With the invention, a wall jack apparatus is provided which does not employ a ladder. With the invention, a wall jack apparatus is provided which employs force multiplication using hydraulics. With the invention, a wall jack apparatus is provided as an electrically powered, hydraulics employing, portable, self-contained unit that can readily be transported to a construction site and utilized at the site. With the invention, a wall jack apparatus is provided which is in the form of a portable unit that is light in weight, is structurally sound, and has relatively few moving parts.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A jack apparatus for lifting a wall frame having at least one horizontal structural member, said apparatus comprising:

a base assembly which includes a central arm support portion, a telescopic lift arm assembly which includes a proximal lift arm end pivotally connected to said arm support portion at a relatively low first connection position and includes a distal lift arm end, said first connection position defining a first axis, a telescopic push arm assembly which includes a proximal push arm end pivotally connected to said arm support portion at a relatively high second connection position and includes a distal push arm end, said second connection position defining a second axis, wherein said distal lift arm end of said telescopic lift arm assembly is pivotally connected to a pivoting portion of said telescopic push arm assembly between said proximal push arm end and said distal push arm end, and a clamping assembly pivotally connected to said distal push arm end, wherein said distal push arm end includes a hinge assembly, said hinge assembly defining a third axis substantially parallel to said first and second axes, wherein said clamping assembly includes:

a first jaw member pivotally connected to said hinge assembly, a second jaw member which pivotally connected to said hinge assembly, said first jaw member and said second jaw adapted to pivot about said third axis to engage said at least one horizontal structural member of said wall frame, and jaw locking means, connected to said first and second jaw members, for locking said first and second jaw members together.

2. The apparatus of claim 1 wherein said base assembly further includes:

a plurality of legs connected to said arm support portion, and a plurality of feet connected to said legs.

3. The apparatus of claim 2 wherein:

said legs project laterally from said arm support portion of said base assembly, and said feet are located substantially horizontally with respect to said arm support portion of said base assembly.

4. The apparatus of claim 1 wherein said jaw locking means includes:

a first locking finer projecting from said first jaw member, a second locking finger projecting from said second jaw member, and a lock pin connected between said first locking finger and said second locking finger.

5. The apparatus of claim 6 wherein:

said first locking finger includes a first pin-receiving channel, said second locking finger includes a second pin-receiving channel, and said lock pin is placed through said first pin-receiving channel and said second pin-receiving channel when said first pin-receiving channel and said second pin-receiving channel are placed in registration.

* * * * *